US005537979A

United States Patent [19]

Nuti

[11] Patent Number: 5,537,979

[45] Date of Patent: Jul. 23, 1996

[54] MIXTURE PREPARATION DEVICE FOR DOUBLE-FEED ENGINES

[75] Inventor: Marco Nuti, Pisa, Italy

[73] Assignee: Piaggio Veicoli Europei S.p.A., Pisa, Italy

[21] Appl. No.: 314,617

[22] Filed: Sep. 29, 1994

[30] Foreign Application Priority Data

Oct. 1, 1993 [IT] Italy ..... MI93A2098

[51] Int. Cl.[6] ..... F02M 7/22

[52] U.S. Cl. ..... 123/438; 261/51

[58] Field of Search ..... 123/73 R, 438; 261/51

[56] References Cited

U.S. PATENT DOCUMENTS

| | | | |
|---|---|---|---|
| 2,103,368 | 12/1937 | Hoof | 261/51 |
| 2,856,169 | 10/1958 | Mustain | 261/51 |
| 2,947,295 | 8/1960 | Aspin | 123/302 |
| 3,931,814 | 1/1976 | Rivere | 123/438 |
| 3,934,562 | 1/1976 | Isaka | 123/73 R X |
| 3,940,459 | 2/1976 | Tipton et al. | 261/23.2 |
| 4,248,185 | 2/1981 | Jaulmes | 123/73 R |

FOREIGN PATENT DOCUMENTS

| | | |
|---|---|---|
| 0006770 | 1/1980 | European Pat. Off. . |
| 0015792 | 9/1980 | European Pat. Off. . |
| 736403 | 11/1932 | France . |
| 2222534 | 10/1974 | France . |
| 1526691 | 1/1970 | Germany . |
| 1148584 | 4/1969 | United Kingdom . |
| 2054050 | 2/1981 | United Kingdom . |

OTHER PUBLICATIONS

Patent Abstracts of Japan, vol. 8, No. 28 (M–274) (1465), Feb. 7, 1984, abstract of JP–A–58–187522.

*Primary Examiner*—Tony M. Argenbright

*Attorney, Agent, or Firm*—Diller, Ramik & Wight

[57] ABSTRACT

A mixture preparation device for double-feed engines having a body (11) in which two ducts are provided, namely a first duct (12) for air feed to the crankcase and a second duct (13) connected to an injection device. Throttle elements (10, 35) are provided for the two ducts (12, 13). In the second duct (13) connected to the injection device there is provided an air-fuel mixture emission unit (29–34) adjustable in its degree of opening, the opening being controlled by transmission elements (49, 50) operationally connected to a shaft (36, 43) carrying one of the throttle elements (35) positioned within the first duct (12) for air feed.

9 Claims, 3 Drawing Sheets

MIXTURE PREPARATION DEVICE FOR DOUBLE-FEED ENGINES

This invention relates to a mixture preparation device for double-feed engines.

Double-feed engines find particular application in the field of two-stroke engines with controlled ignition.

The essential advantage of this type of engine is that scavenging is effected with air whereas the fuel is injected, in the form of a rich mixture (equivalence ratio<1), directly into the combustion chamber. This leads to a considerable reduction in fresh mixture losses at the exhaust.

In such engines, in particular small engines in which an important consideration is production economy and low selling price, the fuel feed components should be as simple as possible. An initial indication regarding the general choice to be made is determined by the fact that the most simple manner of introducing the fuel is by means of a carburation device. In particular, such a device could in the limit be a pipe of narrow cross-section for air passage using the Venturi effect.

In consideration of this known art, the object of the present invention is to provide a device for controlling the engine main air flow and for accurately regulating the quantity of fuel supplied together with the secondary air to an injection device. This object is attained according to the present invention by a mixture preparation device for double-feed engines comprising a body in which two ducts are provided, namely a first duct for air feed to the crankcase and a second duct connected to an injection device, throttle elements being provided for said two ducts, characterised in that in said second duct connected to said injection device there is provided an air-fuel mixture emission unit adjustable in its degree of opening, said opening being controlled by transmission elements operationally connected to a shaft carrying one of said throttle elements positioned within said first duct for air feed.

The structural and operational characteristics and advantages of the device according to the present invention will be more apparent from the following description given by way of non-limiting example with reference to the accompanying drawings, in which.

Figure 1:
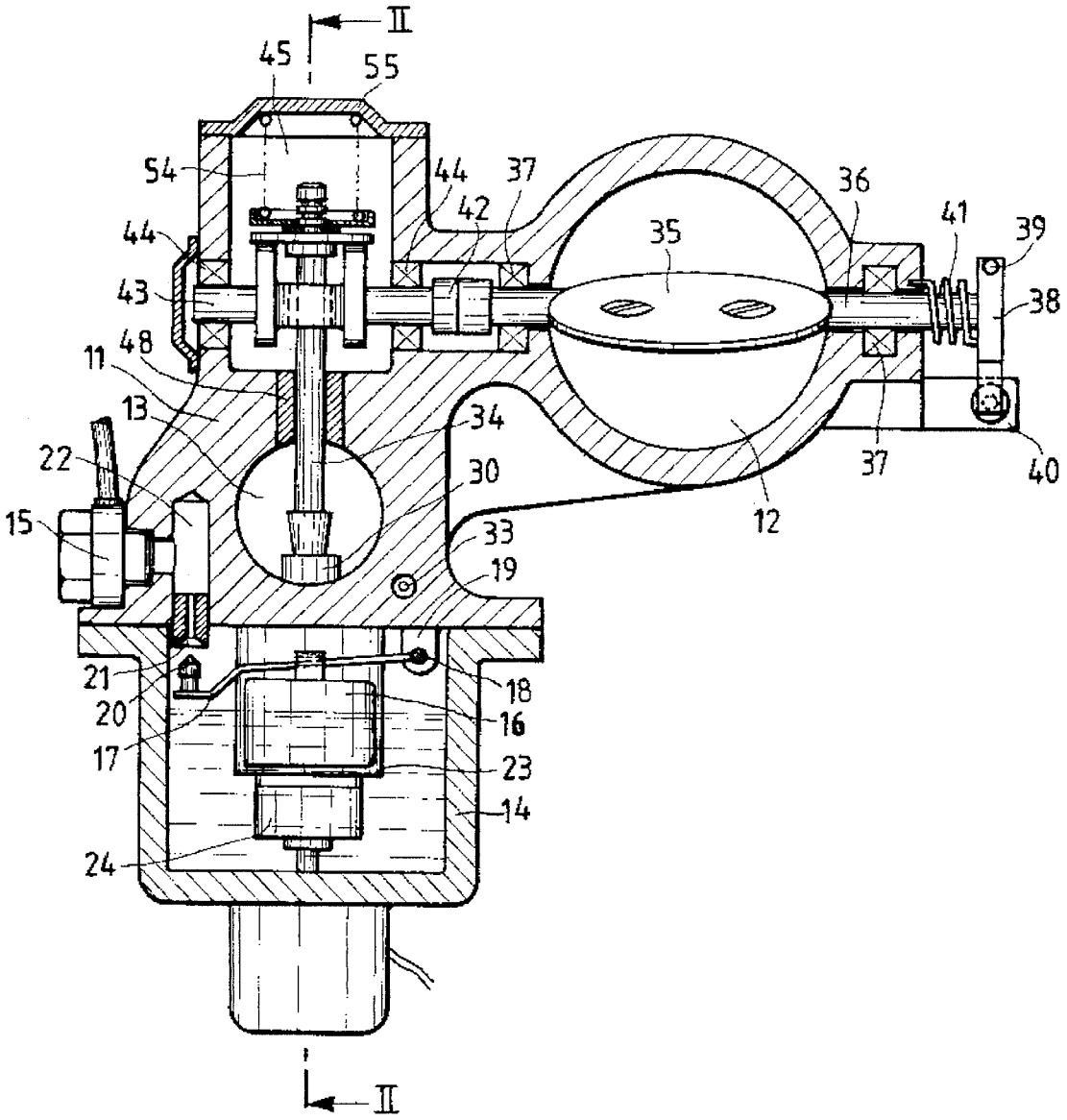
FIG. 1 is a section through the device of the invention taken on the line I—I of FIG. 2.
Figure 2:
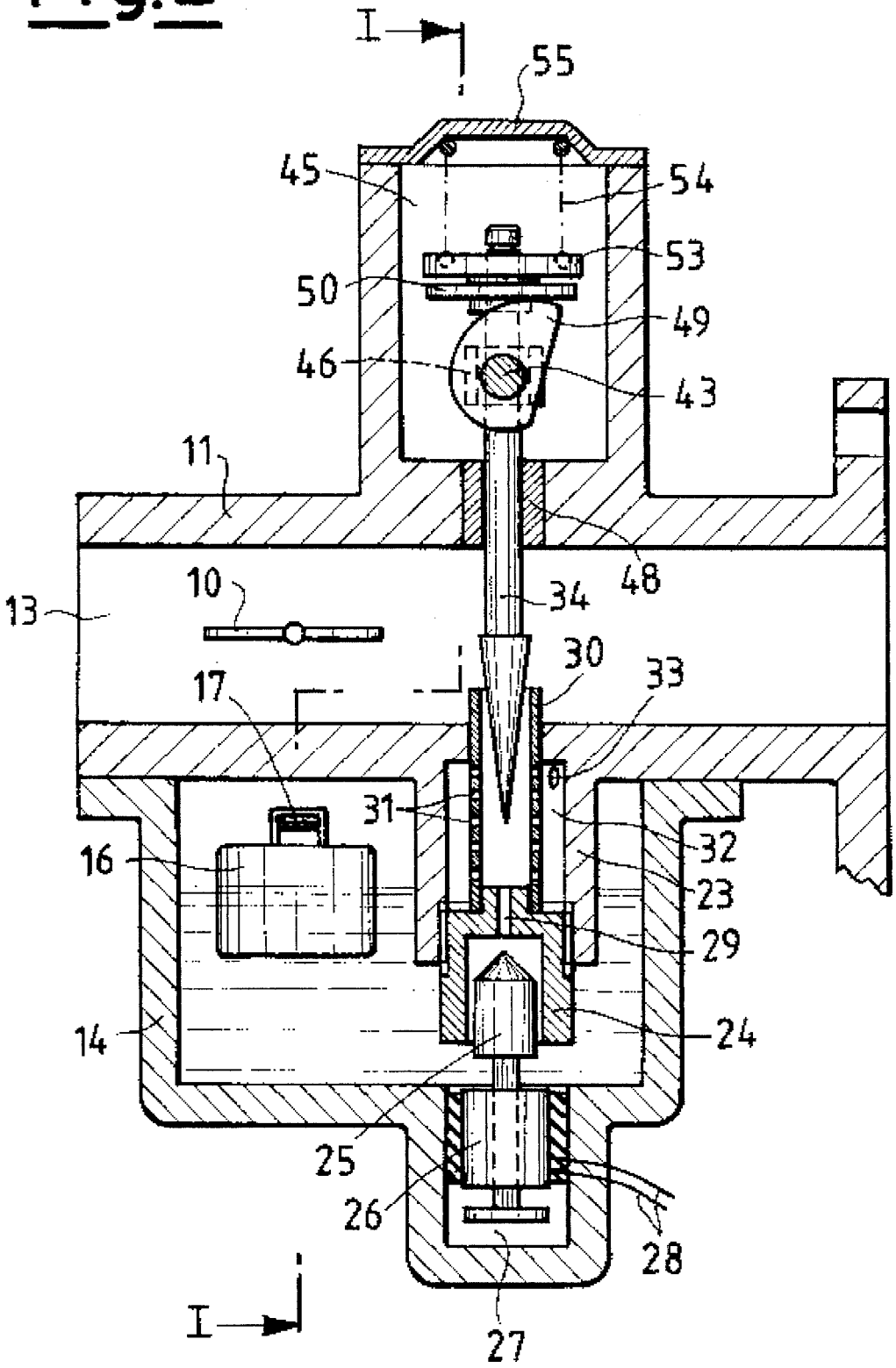
FIG. 2 is a section through the device of the invention taken on the line II—II of FIG. 1.

The drawings show a mixture preparation device for double-feed engines, for example a two-stroke engine with controlled ignition. The device comprises a body 11 in which there are provided two ducts 12 and 13, one for feeding air to a crankcase and the other connected to an injection device, not shown. In each of the two ducts 12 and 13 there are provided relative valving and throttle means, such as butterfly valves 10 and 35.

Below the body 11 in a position corresponding with the second duct 13 there is provided a chamber 14 which receives fuel via a connection element 15 connected to said body 11 for example by screws, not shown. Within the chamber 14 there is provided a fuel level control unit, for example comprising a float 16 supported by an intermediate portion of a lever 17. At one end the lever 17 is pivoted at 18 to an extension 19 of the lower part of the body 11 and at its other end carries an upwardly facing conical needle 20 which sits in a complementary seat 21 provided in the end of a duct 22 formed within the body 11 and connected to the connection element 15.

Communication between the chamber 14 and the second or secondary duct 13 is achieved by an air-fuel mixture emission unit. This emission unit consists essentially of a cup-shaped extension 23 extending from the body 11 below the secondary duct 13. The cup-shaped extension 23 is closed lowerly by a sized nozzle 24 the passage of which is adjustable by a conically shaped valving member 25. The valving member 25 is operated by an electromagnet 26 housed in a suitable cavity 27 provided in the base of the chamber 14 and powered from the outside via wires 28. The nozzle 24 comprises a cylindrical body provided centrally with a sized hole 29 axially aligned with and communicating with an emulsifier tube 30 coaxial to the cup-shaped extension 23 and opening into the secondary duct 13. The emulsifier tube 30 comprises in its lateral surface a series of holes 31 communicating with an annular chamber 32 defined between it and the outer surface of the cup-shaped extension 23, and receiving air originating from the outside via a gauged jet 33 and a relative channel not shown in the figures.

The emulsifier tube 30 upperly receives a needle valve 34, for example with a conical tip, operated by the movement of a butterfly valve 35 provided as the throttle element in the first or main duct 12. Specifically, it should be noted that the butterfly valve 35 is located on a shaft 36 supported on bearings or bushes 37 and driven to rotate from the outside. That end of the shaft facing outwards is provided with a right angled element 38 which is connected to an operating cable 39 and interacts with a position-adjustable stop element 40 which limits its rotation. A spring 41 positioned coaxial to this end of the shaft 36 tends to maintain the shaft in a position providing minimum flow.

The shaft 36 is also connected via a coupling 42 to a second shaft 43 supported on bearings or bushes 44 and positioned in a cavity 45 in the body 11 above the secondary duct 13.

A central portion of the second shaft 43 comprises a profiled enlargement 46 provided with a through aperture 47 in which there is located the upper end of the needle valve 34. The needle valve is guided in its upward and downward movement within a bush 48 connecting the secondary duct 13 to the cavity 45.

Figure 3:
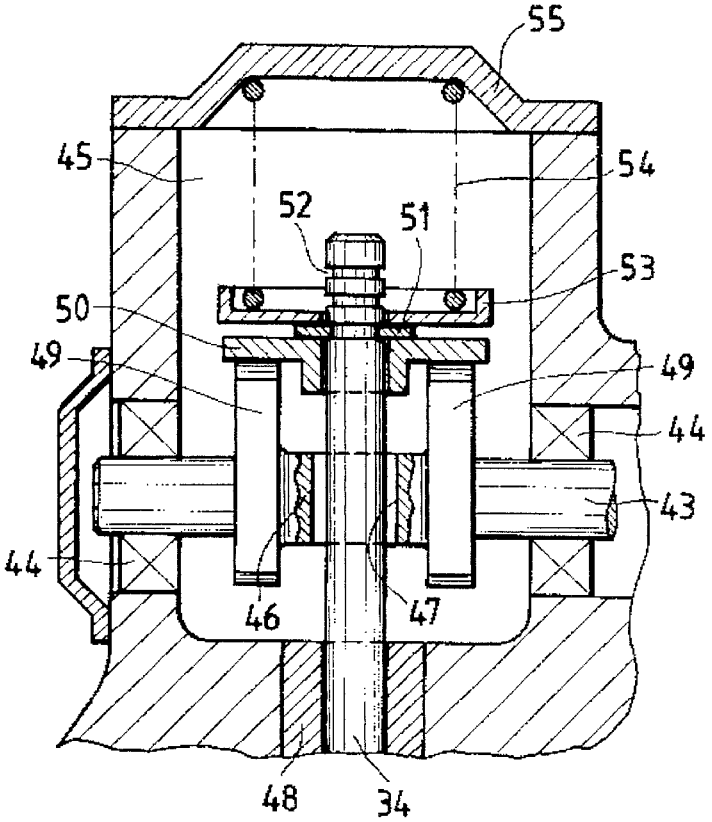
FIG. 3 is an enlarged sectional view of a part of the device shown in FIG. 1.
Figure 4:
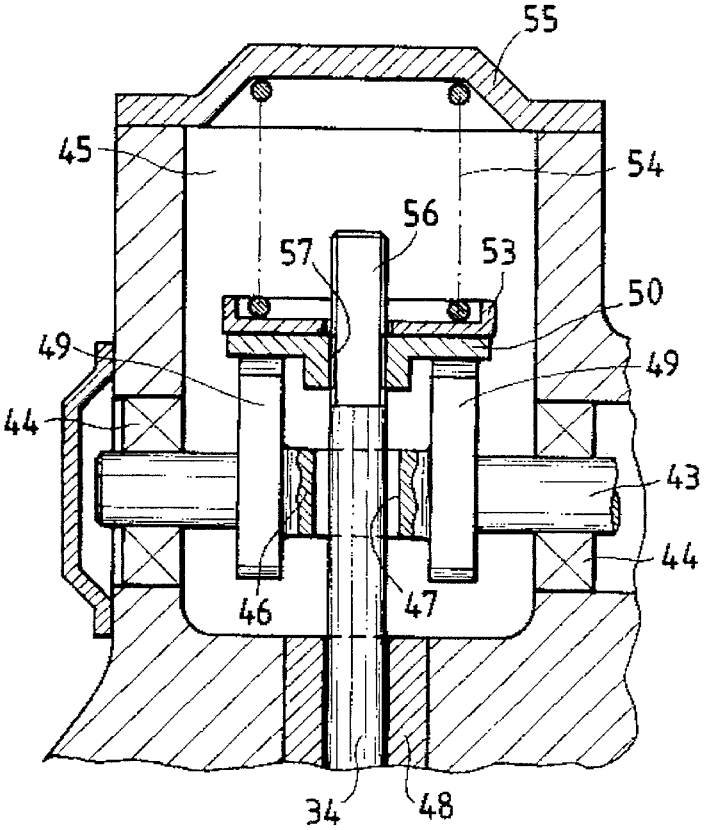
FIG. 4 is an enlarged section through a further embodiment of the part shown in FIG. 3.

The profiled enlargement 46, for example in the form of a rectangular prism, comprises on two opposing faces a pair of cam extensions 49 which project upwards to interact in rotation with a disc 50, also centrally holed and mounted on the needle valve 34. The disc 50 is maintained in position by a split ring 51 inserted into one of a series of annular recesses 52 provided in proximity to the end of the needle valve 34 and arranged to enable the disc 50 to be variously positioned. Above the split ring there is provided a cap 53 centrally holed to receive the needle valve 34. The cap is partially hollowed to contain a spring 54 the other end of which acts against a cover element 55 for the cavity 45 of the body 11. With this arrangement, the rotation of the shaft 36 with variation in the position of the butterfly valve 35 causes the needle valve 34 to move, resulting in greater or lesser flow of air-fuel mixture from the emulsifier tube 30 to the secondary duct 13. The contour of the cam-shaped extensions 49 determines the relationship governing the opening of the emulsifier tube 30. FIG. 4 shows a second embodiment of the part shown in FIG. 3 in relation to the structure determining the upward and downward movement of the needle valve 34. In this second embodiment the end portion of the needle valve 34 is threaded at 56 to enable it to be housed in a complementarily threaded axial hole 57 in the disc 50. There is again provided a centrally holed cap 53 partially hollowed to contain a spring 54 which acts at its other end against a cover element 55 for the cavity 45 in the body 11. A device of the invention operates extremely reliably in the following manner.

When the operating cable 39 is used to rotate the shaft 36 and vary the closure of the main duct 12 by means of the butterfly valve 35, there is a simultaneous action on the mixture feed to the secondary duct 13. In this respect the coupling 42 causes the second shaft 43 to rotate, the cam extensions 49 rotating to raise or lower the disc 50 and consequently the needle valve 34. In this manner greater or lesser emission of mixture by the emulsifier tube 30 is achieved. The mixture is obtained by the joint feed of fuel by the sized nozzle 24 and of air by the gauged jet 33 into the annular chamber 32. The fuel feed is regulated by the valving member 25 which is moved within the cylindrical body 24 by the electromagnet 26. A device is hence obtained with more than one regulation facility, hence improving and ensuring precision of action.

A mixture preparation device according to the present invention achieves great simplification in terms of component parts by providing in a single device both control of the main engine air flow and precise regulation of the air-fuel mixture to be fed to the subsequent injection device.

I claim:

1. A mixture preparation device for double-feed engines comprising a body (11) having a first feed duct (12) for feeding air to an engine crankcase and a second duct (13) connected to an injection device for feeding an air-fuel mixture thereto, first and second throttle elements (9, 16) being provided in said respective first and second ducts (12, 13), said second duct (13) being provided with an air-fuel mixture emission unit (29–34) adjustable in its degree of opening, the opening of said air-fuel mixture emission unit (29–34) being controlled by transmission elements (49, 50) operationally connected to a shaft (36, 43) which carries said first throttle element (35), said air-fuel mixture emission unit (29–34) including an adjustable sized nozzle (24) connected on one side to a fuel chamber (14) and on another side to an emulsifier tube (30) opening into said second duct (13) and having in a lateral surface a series of holes (31) communicating with an external annular chamber (32) receiving air from outside, and said emulsifier tube (30) receiving a needle valve (34) operated by said transmission elements (49–50).

2. A device as claimed in claim 1, characterised in that said sized nozzle (24) comprises a hollow cylindrical body provided with a sized hole (29) and receiving a valving member (25).

3. A device as claimed in claim 2, characterised in that said valving member (25) is operated by an externally powered electromagnet (26).

4. A device as claimed in claim 1, characterised in that said needle valve (34) has a conical tip.

5. A device as claimed in claim 2, characterised in that at least one of said transmission elements (49) is arranged rigid with a second shaft (43) rigidly connected to a first shaft (36) carrying said first throttle element (35).

6. A mixture preparation device for double-feed engines comprising a body (11) having a first feed duct (12) for feeding air to an engine crankcase and a second duct (13) connected to an injection device for feeding an air-fuel mixture thereto, first and second throttle elements (9, 16) being provided in said respective first and second ducts (12, 13), said second duct (13) being provided with an air-fuel mixture emission unit (29–34) adjustable in its degree of opening, the opening of said air-fuel mixture emission unit (29–34) being controlled by transmission elements (49, 50) operationally connected to a shaft (36, 43) which carries said first throttle element (35), and said transmission elements including at least one cam extension (49) rigid with said shaft (36, 43) and interacting with a disc (50) connected to the needle valve (34) of said air-fuel mixture emission unit (29–34).

7. A device as claimed in claim 6, characterised in that said disc (50) is adjustable in position on said needle valve (34) and with it there is associated an elastic element (54) for maintaining it in contact with said at least one cam extension (49).

8. A device as claimed in claim 7, characterised in that one end of said needle valve (34) is provided with a series of annular recesses (52) to receive a split ring (51) for the stable positioning of said disc (50).

9. A device as claimed in claim 7, characterised in that one end of said needle valve (34) is provided with a threaded portion (56) to be housed within a threaded hole (57) provided in the centre of said disc (50).

* * * * *